US011060490B2

(12) United States Patent
McCann et al.

(10) Patent No.: US 11,060,490 B2
(45) Date of Patent: Jul. 13, 2021

(54) AIR INTAKE SYSTEM FOR AN ENGINE

(71) Applicant: Ford Global Technologies, LLC, Dearborn, MI (US)

(72) Inventors: Joseph Matthew McCann, Plymouth, MI (US); David Lowrie, Windsor (CA); James Labadie, Dexter, MI (US); Jeff Boulton, Carleton, MI (US); Preet Kamal Virk, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 11 days.

(21) Appl. No.: 16/577,301

(22) Filed: Sep. 20, 2019

(65) Prior Publication Data

US 2020/0011277 A1 Jan. 9, 2020

Related U.S. Application Data

(63) Continuation-in-part of application No. 15/630,007, filed on Jun. 22, 2017, now Pat. No. 10,514,007.

(51) Int. Cl.

| | |
|---|---|
| ***F02M 35/10*** | (2006.01) |
| ***F02M 35/02*** | (2006.01) |
| ***F02M 35/16*** | (2006.01) |
| ***F02M 35/108*** | (2006.01) |
| ***F02M 35/08*** | (2006.01) |
| ***F02M 35/024*** | (2006.01) |

(52) U.S. Cl.

CPC .... *F02M 35/161* (2013.01); *F02M 35/02441* (2013.01); *F02M 35/02466* (2013.01); *F02M 35/088* (2013.01); *F02M 35/108* (2013.01); *F02M 35/10091* (2013.01); *F02M 35/10209* (2013.01)

(58) Field of Classification Search

CPC ..... F02M 35/161; F02M 35/10091; F02M 35/10209; F02M 35/088; F02M 35/02466; F02M 35/441

See application file for complete search history.

(56) References Cited

U.S. PATENT DOCUMENTS

| | | | |
|---|---|---|---|
| 3,950,157 | A | 4/1976 | Matney |
| 4,396,407 | A | 8/1983 | Reese |
| 4,420,057 | A | 12/1983 | Omote et al. |
| 4,758,460 | A | 7/1988 | Spicer et al. |

(Continued)

FOREIGN PATENT DOCUMENTS

| | | | |
|---|---|---|---|
| CN | 103861364 | A | 6/2014 |

*Primary Examiner* — Jacob M Amick

(74) *Attorney, Agent, or Firm* — Geoffrey Brumbaugh; McCoy Russell LLP

(57) ABSTRACT

In one example, an air intake system is provided. The air intake system includes a first air inlet duct providing intake air to an engine intake conduit, the first air inlet duct including an opening positioned external to an engine compartment. The air intake system also includes a second air inlet duct positioned upstream of the engine intake conduit and external to the engine compartment, the second air inlet duct including a porous material spanning an opening in the second air inlet duct, the porous material having a plurality of defined openings sized to prevent snow from traveling therethrough and collect on the porous material thereby impeding airflow through the second air inlet duct during snowy and icy conditions.

17 Claims, 7 Drawing Sheets

(56) References Cited

U.S. PATENT DOCUMENTS

| | | | | |
|---|---|---|---|---|
| 6,394,128 | B1 | 5/2002 | Concialdi | |
| 6,705,272 | B2 | 3/2004 | Leipelt et al. | |
| 7,393,372 | B2 | 7/2008 | Cassell et al. | |
| 8,048,179 | B2 | 11/2011 | Miller et al. | |
| 8,241,382 | B2 | 8/2012 | Pham et al. | |
| 9,046,063 | B2 | 6/2015 | Landgraf et al. | |
| 9,062,639 | B1 * | 6/2015 | MacKenzie | B62D 25/18 |
| 9,068,537 | B2 | 6/2015 | Khami et al. | |
| 9,463,399 | B2 | 10/2016 | Elayed et al. | |
| 10,125,728 | B2 | 11/2018 | Mackenzie et al. | |
| 2002/0185323 | A1 | 12/2002 | Tsutsumi et al. | |
| 2006/0006012 | A1 | 1/2006 | Khouw et al. | |
| 2007/0272197 | A1 | 11/2007 | Kim | |
| 2010/0140004 | A1 | 6/2010 | Ohzono et al. | |
| 2010/0170734 | A1 | 7/2010 | Teraguchi et al. | |
| 2011/0017535 | A1 * | 1/2011 | Salvesen | F02M 35/08<br>180/68.3 |
| 2011/0100337 | A1 | 5/2011 | Orth | |
| 2013/0019833 | A1 | 1/2013 | Li et al. | |
| 2014/0165961 | A1 | 6/2014 | Patel et al. | |
| 2015/0159599 | A1 * | 6/2015 | Baldwin | B01D 46/002<br>95/286 |
| 2015/0274003 | A1 | 10/2015 | Laakso et al. | |
| 2016/0090946 | A1 | 3/2016 | Tomlin et al. | |
| 2016/0090947 | A1 | 3/2016 | Tomlin et al. | |
| 2016/0319783 | A1 | 11/2016 | Roten et al. | |

* cited by examiner

AIR INTAKE SYSTEM FOR AN ENGINE

CROSS-REFERENCE TO RELATED APPLICATION

The present application is a continuation-in-part of U.S. Non-Provisional patent application Ser. No. 15/630,007, entitled "AIR INTAKE SYSTEM FOR AN ENGINE", and filed on Jun. 22, 2017. The entire contents of the above-listed application are hereby incorporated by reference for all purposes.

FIELD

The present description relates generally to an air intake system for an internal combustion engine.

BACKGROUND/SUMMARY

Engines have, in the past, utilized multiple air inlets to feed air to airboxes. Using multiple inlets provides a high flowrate of filtered air to internal combustion engines. High intake flowrates may be particularly desirable in compression ignition engines, which may require during certain operating conditions, a large amount of intake airflow to drive combustion. However, depending on the location of the air inlet the inlet may be susceptible to damage, clogging, etc., from external road debris (e.g., snow, ice, rocks, etc.).

Previous intake systems have attempted to protect air inlets by placing the inlet in a more shielded vehicle location to reduce the inlet's exposure to road debris. One example approach shown by MacKenzie et al., in U.S. Pat. No. 9,062,639, is a dual inlet air induction system. In MacKenzie's air induction system, one air inlet is positioned under an engine compartment hood and another air inlet is located in a fender panel. The inventors have recognized several drawbacks with MacKenzie's system. For instance, in MacKenzie's system, the inlet positioned under the hood receives air at elevated temperatures, due to the inlet's proximity to hot engine components. Elevated intake air temperatures can decrease combustion efficiency and in some cases may lead to pre-ignition, knock, etc. Therefore, MacKenzie's system as well as other intake systems have in the past made tradeoffs between the degree of air inlet shielding and the temperature of the air drawn into the inlet.

Other attempts have been made to actively control airflow through different air inlets. For instance, one example approach shown by Miller et al., in U.S. Pat. No. 8,048,179, includes an intake system having two air inlets with one of the inlets having a flow valve positioned therein. The valve is opened during cold weather conditions to draw hot air into a portion of the intake system that may be obstructed by snow. However, the active control system, described in Miller, may be prone to malfunction or in some cases failure due to the complexity of the control system used to adjust the flow valve. Furthermore, active flow valves may be costly and as a result the production costs of vehicles using active valves may be unduly increased. Additionally, Miller's system only allows a single airflow path to be opened at any one time.

The inventors have recognized the aforementioned problems and confronting these problems developed an air intake system. The air intake system includes a first air inlet duct providing intake air to an engine intake conduit. The first air inlet duct includes an opening positioned external to an engine compartment. The air intake system also includes a second air inlet duct positioned upstream of the engine intake conduit and external to the engine compartment. The second air inlet duct includes a porous material that spans an opening in the second air inlet duct. The porous material allows air to flow therethrough, but traps ice and snow therein thereby blocking air flow through the second inlet duct during icy and snowy operating conditions. In this way, one air inlet may provide air to the engine regardless of operating conditions, on the one hand. While on the other hand, another air inlet can provide selective airflow to the engine. The porous material in the second air inlet enables an increase in airbox inflow, during low hazard conditions. Conversely, during high hazard conditions (e.g., cold weather), the porous material inhibits airflow through an exposed air inlet duct to reduce the likelihood of damage to the system and adverse engine operation caused by external debris and ingesting excessive snow and ice into the engine.

In one example, the second air inlet duct may be positioned in a less protected location than the first air inlet duct to enable an increased amount of air to be drawn into the second duct. For instance, the second air inlet duct may be positioned below and/or in a more forward location than the first air inlet duct. In this way, the second air inlet duct may draw in a large amount of low temperature air when the porous material is above a threshold temperature. Consequently, the air intake system may provide a greater amount of airflow to the engine, to increase combustion efficiency, when inclement conditions are not occurring. Conversely, during snowy conditions, for instance, the porous material may adapt to block the second air inlet duct altogether to prevent snow, ice, etc., from entering the air intake system. Consequently, the air intake system can be protected from external debris during selected conditions, thereby decreasing the likelihood of engine degradation and in some cases shutdown during inclement conditions. Moreover, the porous material may be less costly and more robust than mechanical flow control valves that act to block inlet conduits during inclement conditions. Consequently, the manufacturing costs of the system may be reduced when a foam plug is incorporated into an inlet duct.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 7 shows a detailed view of the second air inlet in the air intake system, shown in

FIG. 6.

DETAILED DESCRIPTION

The following description relates to an air intake system providing airflow to an engine. The air intake system may include, in one example, a first air inlet duct spaced away from the second air inlet duct. Additionally, the second air inlet duct may include a porous material such as a sheet of mesh or a temperature sensitive piece of foam extending across an opening of the second air inlet duct. The porous material may be designed to block the opening when below a threshold temperature (e.g., at or near freezing) and drawing in snow and allow airflow therethrough when above the threshold temperature. In this way, when external environmental factors (e.g., snowy/icy conditions) are likely to cause intake system degradation airflow through the second air inlet duct may be inhibited. For instance, while driving in snowy conditions, previous systems, may suck snow into an air inlet which may cause significant engine degradation or even shut-down, in some instances. However, in the air intake system described herein pores in the porous material may clog up with snow and/or ice particles to block the snow from traveling into the intake system, during cold temperature conditions. However, during lower hazard conditions (e.g., above freezing ambient temperature conditions) pores in the porous material may become unblocked to permit airflow therethrough to provide increased intake airflow. In this way, the porous material passively adapts to changing environmental conditions. Consequently, during higher risk conditions the porous material acts to reduce the likelihood of engine degradation and during lower risk conditions the foam allows airflow therethrough to facilitate an increase in combustion efficiency. The porous material, in one example, may be a foam constructed out of polyether to enable the aforementioned temperature dependent duct blocking capabilities. Alternatively, the porous material may be a sheet of mesh forming a grid of holes having a defined hole size. The sheet of mesh may be constructed of polypropylene, nylon and the like, and it may include desirable filler material to improve durability and rigidity such as glass, talc, metallic elements and alloys, recycled content and the like.

Additionally, providing the porous material in the inlet duct may enable the inlet duct to be positioned in a less protected location spaced away from hot engine components, if desired. For instance, the second air inlet duct may be placed near a front grille of the vehicle. As a result, the air delivered to the engine may have a lower temperature, thereby increasing the engine's combustion efficiency. Moreover, the porous material may reduce the construction cost of the system when compared to system's using costly active mechanical control valves.

Figure 1:
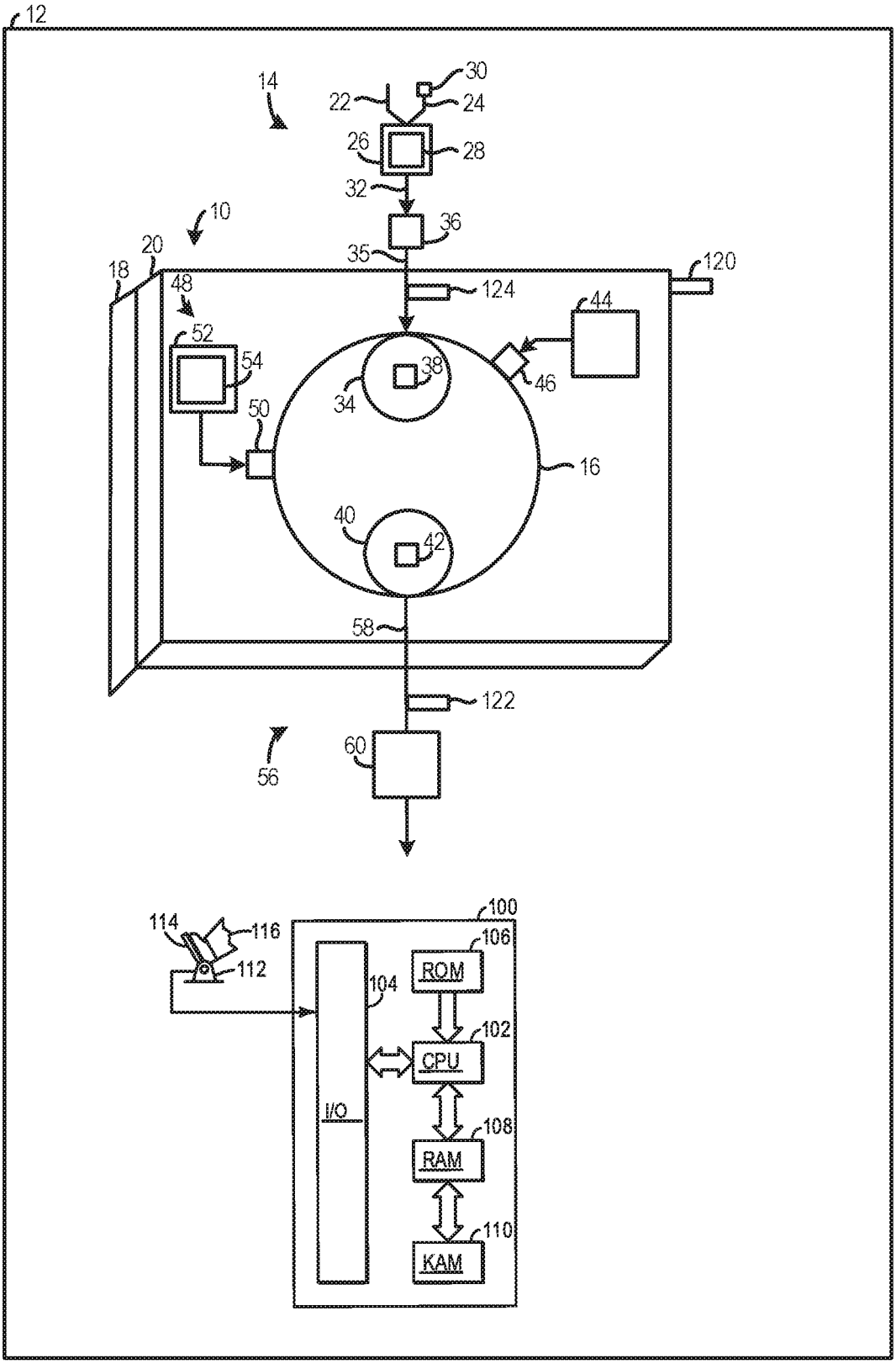
FIG. 1 shows a schematic depiction of an internal combustion engine including an air intake system.
Figure 2:
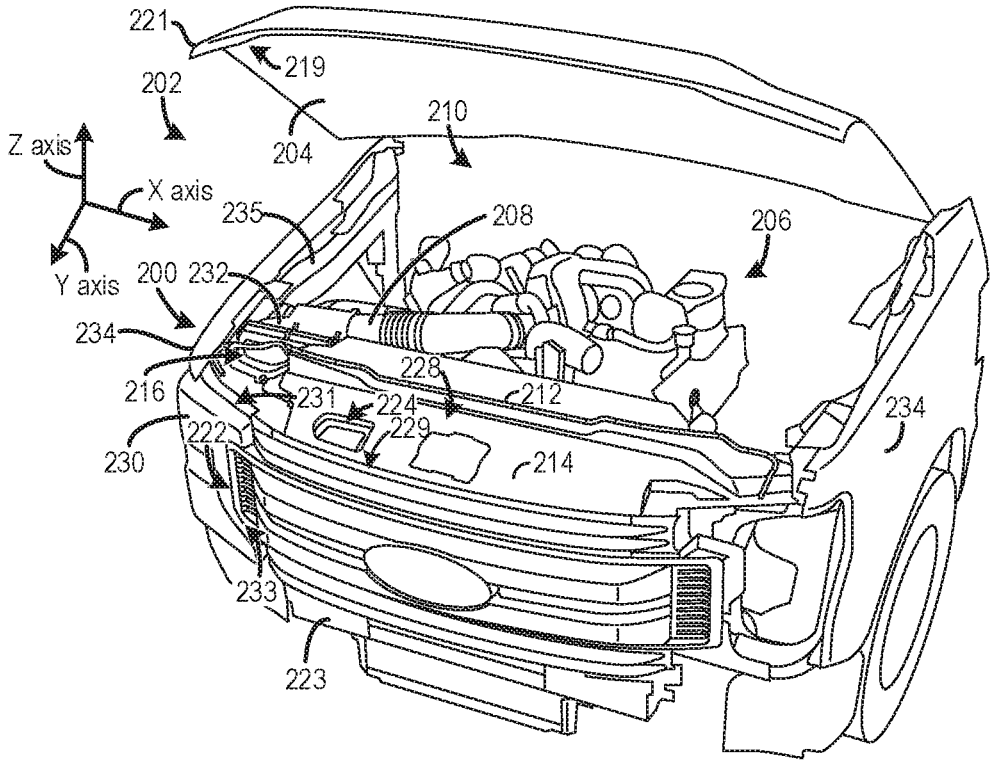
FIG. 2 shows a perspective view of an exemplary vehicle including an air intake system.
Figure 3:
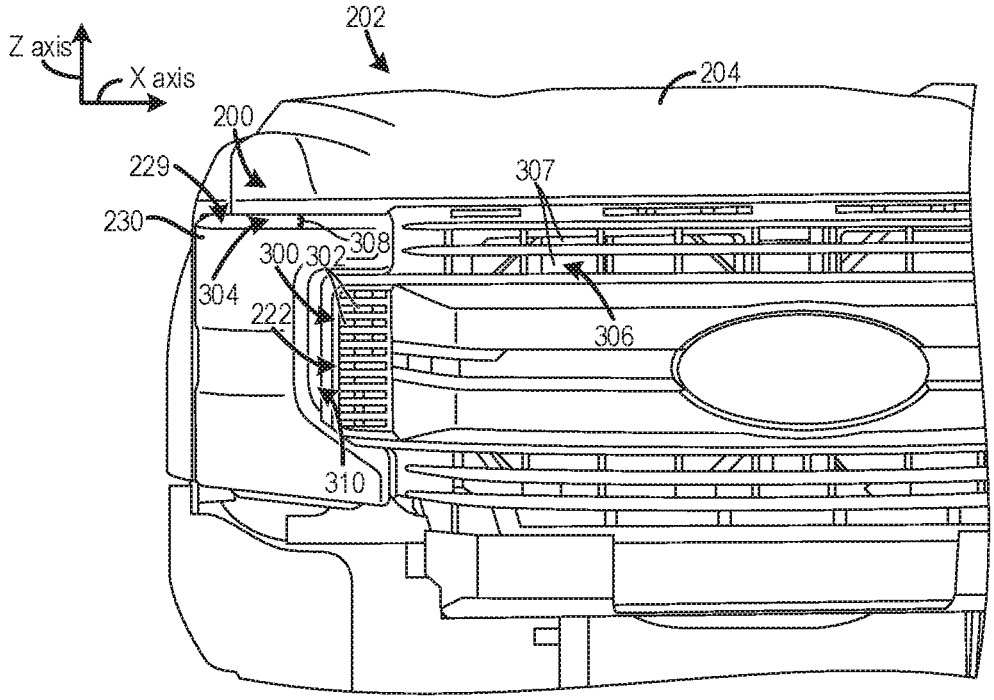
FIG. 3 shows a front view of the vehicle and the air intake system, shown in FIG. 2.
Figure 4:
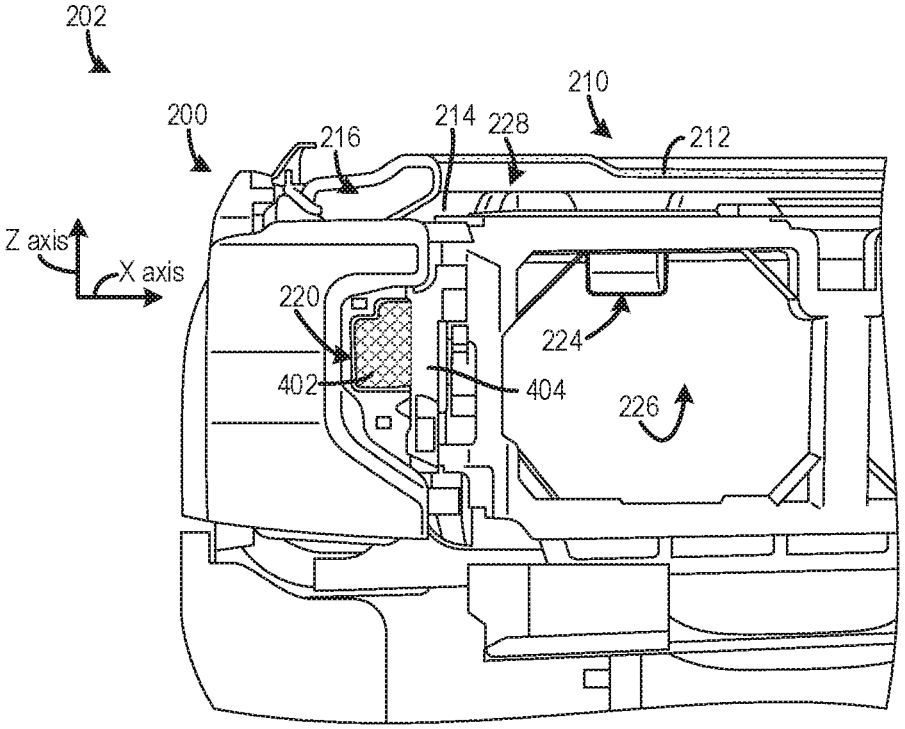
FIG. 4 shows a detailed view of a portion of the air intake system, shown in FIG. 2.
Figure 5:
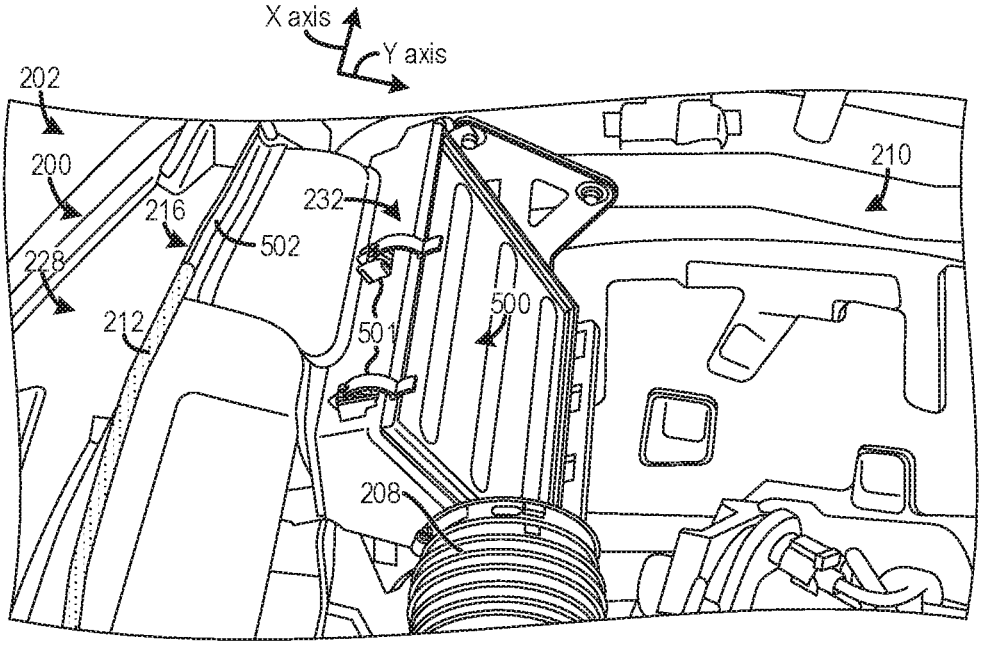
FIG. 5 shows another detailed view of the air intake system, shown in FIG. 2.
Figure 6:
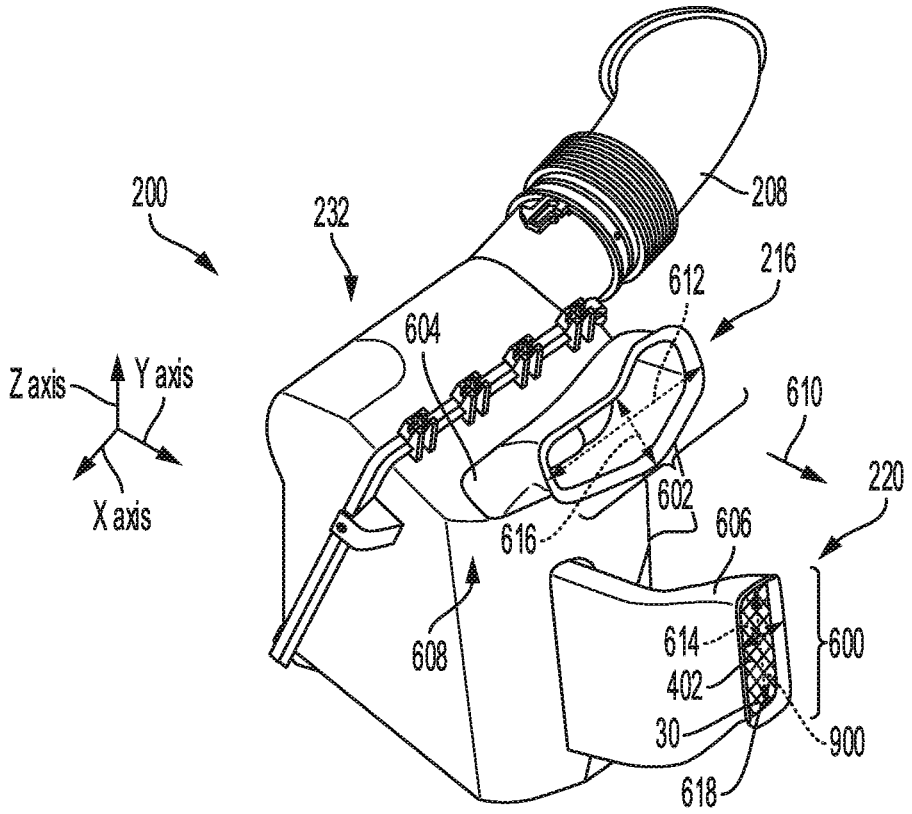
FIG. 6 shows a detailed view of the first and second air inlets and airbox in the air intake system, shown in FIG. 2.
Figure 7:
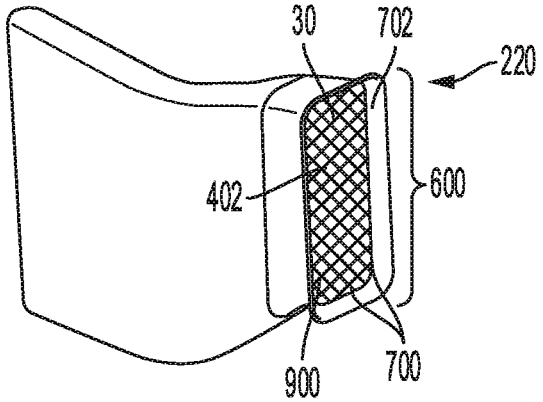
Figure 8:
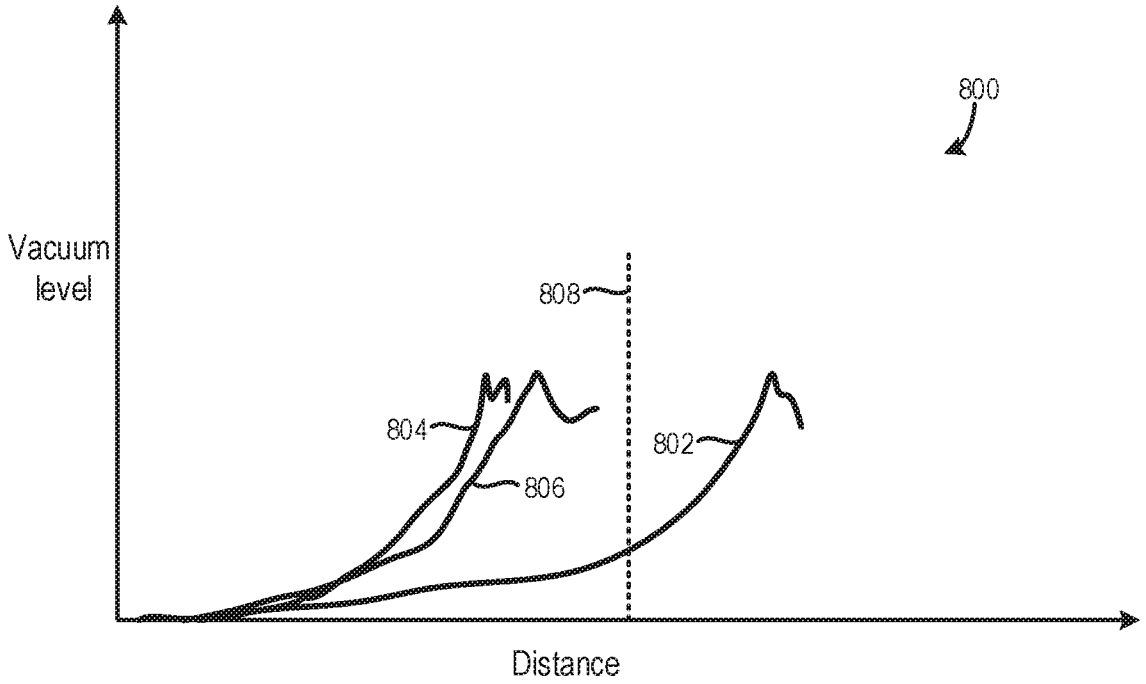
FIG. 8 shows a graph depicting exemplary performance curves of an air intake system.
Figure 9:
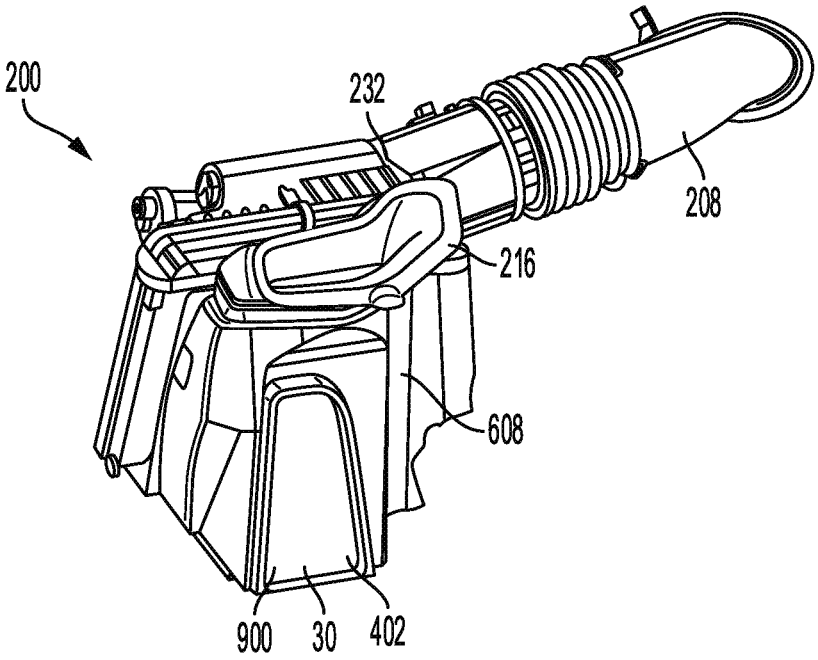
FIG. 9 shows a detailed view of the first and second air inlets and airbox of FIG. 6 showing a section of the second air inlet removed to show internal detail.
Figure 10:
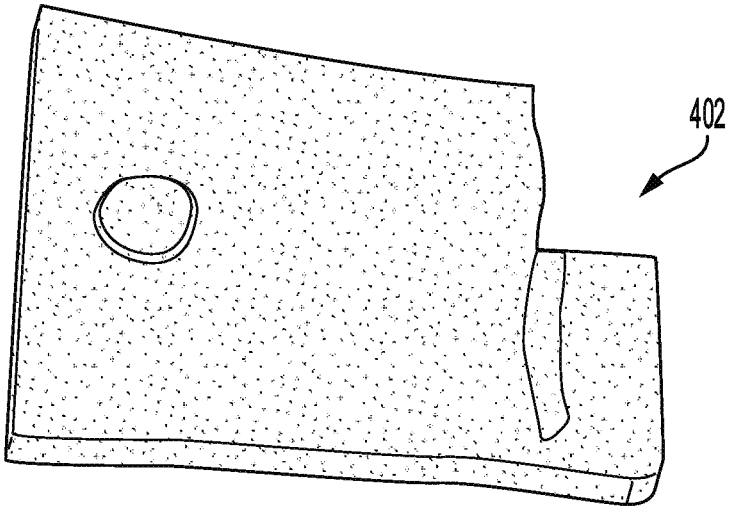
FIG. 10 shows a first possible porous material for use in the second air inlet in accordance with an embodiment of the present invention.
Figure 11:
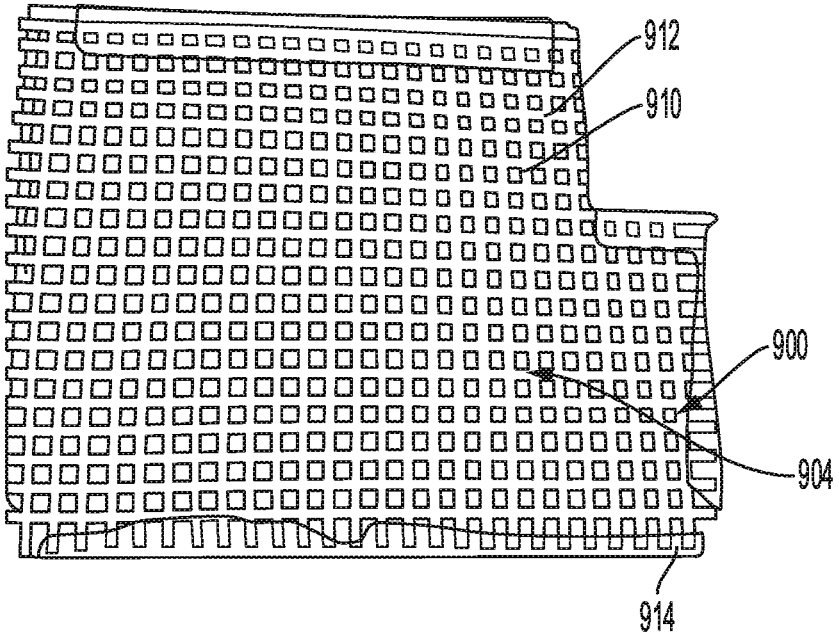
FIG. 11 shows a second possible porous material for use in the second air inlet in accordance with an embodiment of the present invention.
Figure 12:
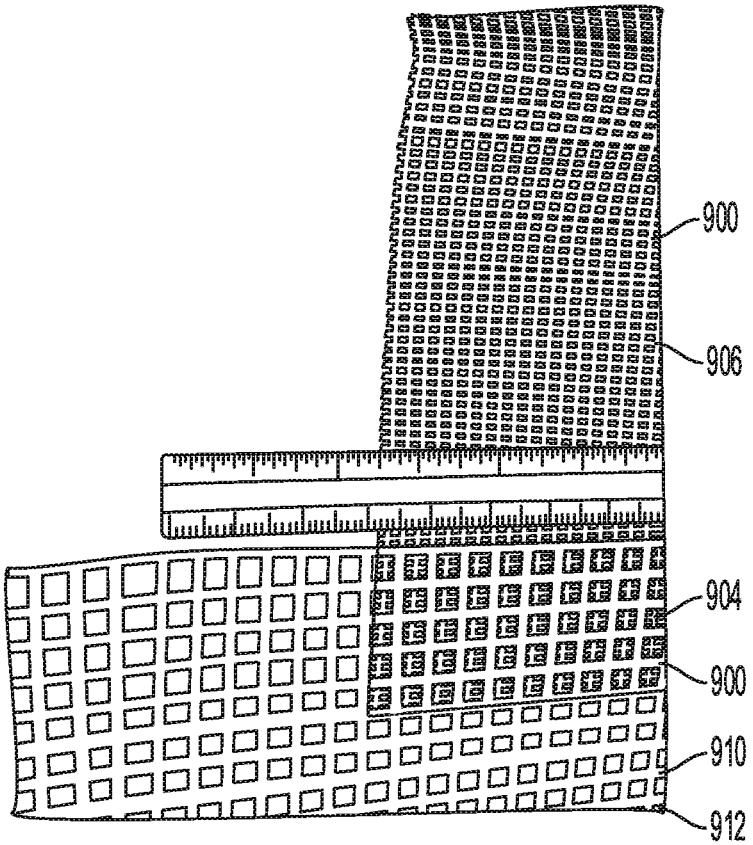
FIG. 12 shows a third possible porous material for use in the second air inlet in accordance with an embodiment of the present invention.

FIG. 1 shows a schematic depiction of an engine employing a robust air intake system with multiple air inlet ducts. FIG. 2 shows an example of a vehicle with an air intake system. FIG. 3 shows a front view of the air intake system, shown in FIG. 2. FIGS. 4 and 5 show more detailed views of the air intake system shown in FIG. 2. FIGS. 6 and 7 show detailed views of a first and second air inlet duct, an airbox, and an engine intake conduit included in the air intake system, shown in FIG. 2. FIG. 8 shows an exemplary graph depicting the performance of the air intake system, described herein. FIG. 9 shows a detailed view of the first and second air inlets and airbox of FIG. 6 with a section the second air inlet removed to show internal detail. FIG. 10 shows a first possible porous material in the form of a foam plug. FIGS. 11 and 12 show alterative possible porous materials in the form of sheets of mesh.

Turning to FIG. 1, an engine 10 in a vehicle 12 with an air intake system 14 providing airflow to the engine 10 is schematically illustrated. Although, FIG. 1 provides a schematic depiction of various engine, vehicle, and air intake system components, it will be appreciated that at least some of the components may have a different spatial positions and greater structural complexity than the components shown in FIG. 1. The components structural characteristics are discussed in detail herein, with regard to FIGS. 2-12.

The air intake system 14 specifically provides intake air to a cylinder 16. The cylinder 16 is formed by a cylinder block 18 coupled to a cylinder head 20. Although, FIG. 1 depicts the engine 10 with one cylinder, the engine 10 may have an alternate number of cylinders, in other examples. For instance, the engine 10 may include two cylinders, three cylinders, six cylinders, etc., in other examples.

The air intake system 14 includes a first air inlet duct 22 and a second air inlet duct 24. Each of the first and second air inlet ducts, 22 and 24, provide intake air to an airbox 26 having a filter 28 configured to remove particulates from air flowing therethrough. The first and second air inlet ducts may be spaced away from one another and positioned in strategic locations that provide varying degrees of protection from external debris, described in detail herein.

The second air inlet duct 24 includes a porous material 30 such as a foam plug 402 (FIGS. 4, 6, 7 and 10) or sheet of mesh 900 (FIGS. 4, 6, 7, 11 and 12) designed to selectively impede airflow through the second air inlet duct 24. Specifically, the porous material 30 may selectively impede airflow through the second air inlet duct 24 based on the temperature and/or pore size of the material.

For instance, the porous material 30 may be a foam plug 402 that impedes (e.g., inhibit) airflow therethrough when the plug is below a threshold temperature (e.g., 0 degrees Celsius, 2 degrees Celsius, 5 degrees Celsius, in the range between −5 degrees Celsius and 5 degrees Celsius, in the range between 1 degrees Celsius and 3 degrees Celsius, etc.) and snow and/or ice particulates have been drawn into the opening of the duct. Thus, when the foam plug is below the threshold temperature pores in the plug may clog with snow particles and freeze to block airflow therethrough. On the other hand, when the foam plug 402 is above the threshold temperature the foam adapts to permit airflow through pores in the foam. In this way, when above the threshold temperature, the foam plug essentially thaws and returns to a porous state where air can travel through the plug.

To enable the aforementioned temperature dependent adaptation, the foam plug 402 may be include a foam material, such as polyether. Specifically, in one example, the foam plug 402 may be constructed solely out of polyether. However, other foam materials have been contemplated. Further, in one example, a porosity of the foam plug may be between 30 and 80 pores per inch, to provide the plug with desired temperature dependent airflow characteristics. When the foam plug has a porosity between 30 and 80 pores per inch a desired amount of airflow may flow therethrough when above a threshold temperature and conversely when the foam plug is below the threshold temperature the foam may substantially inhibit airflow therethrough, due to snow particulates blocking pores in the foam. In another example, the porosity of the foam may be between 40 and 60 pores per inch. It will be appreciated that the foam plug 30 may also assist in blocking large debris (e.g., pebbles, leaves, insects, etc.,) and rain droplets from entering a downstream air filter. Additionally, in one specific example, the density of the foam plug may be selected to address specific vehicle working applications (e.g., mining vehicles, border patrol vehicles, etc.,) such as vehicles subjected to large amounts of dust, dirt, and/or sand. In one example, such as in air intake systems designed for dusty and sandy environments, the foam plug may include foam having a density around 30 pores per inch. In another example, such as in air intake systems designed for cold weather environments, the foam plug may include foam having a density around 80 pores per inch. However, foam plugs with other densities may be used, in other examples.

Alternatively, the porous material 30 may be a sheet of mesh 900 extending across the second air inlet duct 24. The mesh 900 may be substantially planar as best shown in FIGS. 11 and 12, and define a grid of openings having a defined opening size 910 spaced-apart from each other by mesh supporting structure 912 having a defined width 914. The defined opening size 910 combined with the defined width 914 of the supporting structure 912 are selected so as to allow snow and ice to build up on the mesh 900 when present during operation of the engine. The mesh 900 also allows air to flow freely therethrough when snow and ice are not present. During times when snow or ice are present, their buildup on the mesh 900 blocks the flow of air through the second air inlet duct 24, thereby allowing the first inlet duct to provide the majority of air to the engine. In contrast, when snow and ice are not blocking the flow or air through the mesh 900, the second inlet duct 22 provides air to the engine.

A first exemplar substantially planar sheet of mesh 900 is shown in FIGS. 11 and 12 and marked as mesh 904, and a second exemplar substantially planar sheet of mesh 900 is shown in FIG. 12 and marked as mesh 906. The sheet of mesh 900 may be constructed with a variety of materials such as polypropylene, metal or alloy, nylon and the like, and it may include desirable filler material to improve durability and rigidity such as glass, talc, metallic elements and alloys, recycled content and the like. The opening size 912 may be substantially square shaped as shown. Particularly desirable snow clogging properties have been obtained with the square holes are substantially between 1 millimeter by 1 millimeter to 5 millimeters by 5 millimeters across, inclusive with a support structure 912 with a 2 millimeter defined width 914 between the square holes. Other defined widths such as those between 0.5 millimeters to 4 millimeters, inclusive, may also provide snow trapping benefits.

If desired for a particular application, circular, rectangular, diamond, triangular, trapezoidal or other shaped holes may be provided in the porous material. A circular hole pattern of 5 millimeter holes with 2 millimeter defined width 914 support structure 914 therebetween has also been found to work well at collecting snow and ice.

The sheet of mesh 900, 904, 906 as the porous material 30 may be preferred in some applications over a foam plug 402 depending on the vehicle program requirements or the powertrain performance requirements. In some operating environments the foam plug may be more restrictive of air flow during normal "non-snow" driving than the sheet of mesh 900 with large hole opening size 912.

The airbox 26 feeds intake air to an engine intake conduit 32. The engine intake conduit 32, in turn, provides air to an intake valve 34 coupled to the cylinder 16. A throttle 36 may be positioned in an engine intake conduit 35 positioned downstream of the engine intake conduit 32. It will be appreciated that in other examples, such as in the case of a multi-cylinder engine, an intake manifold may be coupled to the engine intake conduit and provide intake air to a plurality of intake valves.

The intake valve 34 may be actuated by an intake valve actuator 38. Likewise, an exhaust valve 40 may be actuated by an exhaust valve actuator 42. In one example, both the intake valve actuator 38 and the exhaust valve actuator 42 may employ cams coupled to intake and exhaust camshafts, respectively, to open/close the valves. Continuing with the cam driven valve actuator example, the intake and exhaust camshafts may be rotationally coupled to a crankshaft. Further in such an example, the valve actuators may utilize one or more of cam profile switching (CPS), variable cam timing (VCT), variable valve timing (VVT) and/or variable valve lift (VVL) systems to vary valve operation. Thus, cam timing devices may be used to vary the valve timing, if desired. In another example, the intake and/or exhaust valve actuators, 38 and 42, may be controlled by electric valve actuation. For example, the valve actuators, 38 and 42, may be electronic valve actuators controlled via electronic actuation. In yet another example, the cylinder 16 may alternatively include an exhaust valve controlled via electric valve actuation and an intake valve controlled via cam actuation including CPS and/or VCT systems. In still other embodiments, the intake and exhaust valves may be controlled by a common valve actuator or actuation system.

An ignition system 44 may provide spark to the cylinder 16 via an ignition device 46 (e.g., spark plug) at desired time intervals. However, in compression ignition configurations the engine 10 may not include the ignition system 44. Additionally, a fuel delivery system 48 is also shown in FIG. 1. The fuel delivery system 48 provides pressurized fuel to the fuel injector 50 from a fuel tank 52 having a fuel pump 54. In the depicted example, the fuel injector 50 is a direct fuel injector. However, additionally or alternatively, the fuel delivery system may be configured to deliver what is commonly referred to in the art as port fuel injection via a port fuel injector positioned upstream of the intake valve. The fuel delivery system 48 may include conventional components such as additionally or alternative fuel pumps, check valves, return lines, etc., to enable fuel to be provided to the injectors at desired pressures.

An exhaust system 56 configured to manage exhaust gas from the cylinder 16 is also included in the vehicle 12, depicted in FIG. 1. The exhaust system 56 includes the exhaust valve 40 coupled to the cylinder 16, and an exhaust conduit 58. The exhaust system 56 also includes an emission control device 60. The emission control device 60 may include filters, catalysts, absorbers, etc., for reducing tailpipe emissions.

FIG. 1 also shows a controller 100 in the vehicle 12. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 10. The sensors may include engine coolant temperature sensor 120, exhaust gas sensors 122, an intake airflow sensor 124, etc. Additionally, the controller 100 is also configured to receive throttle position (TP) from a throttle position sensor 112 coupled to a pedal 114 actuated by an operator 116.

Additionally, the controller 100 may be configured to trigger one or more actuators and/or send commands to components. For instance, the controller 100 may trigger adjustment of the throttle 36, intake valve actuator 38, exhaust valve actuator 42, ignition system 44, and/or fuel delivery system 48. Therefore, the controller 100 receives signals from the various sensors and employs the various actuators to adjust engine operation based on the received signals and instructions stored in memory of the controller.

During engine operation, the cylinder 16 typically undergoes a four stroke cycle including an intake stroke, compression stroke, expansion stroke, and exhaust stroke. It will be appreciated that the cylinder may also be referred to as a combustion chamber. During the intake stroke, generally, the exhaust valves close and intake valves open. Air is introduced into the cylinder via the corresponding intake conduit, and the piston moves to the bottom of the cylinder so as to increase the volume within the cylinder. The position at which the piston is near the bottom of the cylinder and at the end of its stroke (e.g., when the cylinder is at its largest volume) is typically referred to by those of skill in the art as bottom dead center (BDC). During the compression stroke, the intake valves and exhaust valves are closed. The piston moves toward the cylinder head so as to compress the air within cylinder. The point at which the piston is at the end of its stroke and closest to the cylinder head (e.g., when the cylinder is at its smallest volume) is typically referred to by those of skill in the art as top dead center (TDC). In a process herein referred to as injection, fuel is introduced into the cylinder. In a process herein referred to as ignition, the injected fuel in the cylinder is ignited by a spark from an ignition device (e.g., spark plug), resulting in combustion. It will be appreciated that in other examples the engine may employ compression ignition. Therefore, the ignition system may be omitted from the engine, in some instances. A crankshaft converts this piston movement into a rotational torque of the rotary shaft. During the exhaust stroke, in a traditional design, exhaust valves are opened to release the residual combusted air-fuel mixture to the corresponding exhaust passages and the piston returns to TDC.

FIGS. 2-5 show different views and features of an exemplary air intake system 200 and vehicle 202 and FIGS. 6 and 7 shows detailed views of the air intake system 200. It will be appreciated that the air intake system 200 and the vehicle 202 may be similar to the air intake system 14 and the vehicle 12, shown in FIG. 1. In FIGS. 2-7 coordinate axes, X, Y, and Z are provided for reference. In one example, the Z axis may be parallel to a gravitational axis. Further, the X axis may be a lateral or horizontal axis and the Y axis may be a longitudinal axis. However, in other examples, the air intake system 200 and the vehicle 202 may have other orientations. Turning to FIG. 2, a perspective view of the vehicle 202 and air intake system 200, is shown. The vehicle 202 includes an engine hood 204. In FIG. 2, the engine hood 204 is illustrated in an open position to reveal the components positioned below the hood (i.e., engine 206, engine intake conduit 208, etc.). However, it will be appreciated, that the engine hood 204 may be closed to seal an engine compartment 210, when the vehicle 202 is in motion. In particular, the engine hood 204 may at least partially seal on an engine compartment seal 212 extending laterally across a beauty cover 214, when in a closed position.

FIG. 2 also shows a first air inlet duct 216. It will be appreciated that the first air inlet duct 216 may be positioned below a front section 219 of the engine hood 204 when the engine is in the closed position. The boundary of the front section 219 may be the interface between the engine hood 204 and the engine compartment seal 212 when the hood is closed. Specifically, when the engine hood 204 is closed the first air inlet duct 216 may be adjacent to a front corner 221 of the engine hood 204. In this way, the first air inlet duct 216 can be spaced away from hot engine components located in more central locations under the engine hood 204 to reduce the temperature of the air entering the duct. Furthermore, the front section 219 of the engine hood 204, when closed, extend down over the first air inlet duct 216 to shield the duct from external debris. The first air inlet duct 216 provides airflow to an airbox 232. A second air inlet duct 220, shown in FIG. 4, is positioned behind a front grille 222, shown in FIG. 2. The front grille 222 is positioned above a front bumper shell 223, in the illustrated example. Additionally, the second air inlet duct 220 provides air flow to the airbox 232, during certain operating conditions. An air conduit 224 is also shown, in FIG. 2. The air conduit 224 extends from a first compartment 226 behind the front grille 222, shown in FIG. 4, to a second compartment 228, below the engine hood 204, when the hood is closed. Specifically, the second compartment 228 is positioned external to the engine compartment 210 and in front of the engine compartment seal 212. Moreover, the beauty cover 214 may form a lower boundary of the second compartment 228. Furthermore, the second compartment 228 may receive airflow from a gap 308, shown in FIG. 3, between the engine hood 204 and an upper section 231 of a headlamp 230, when the hood is closed. As shown, the gap 308 also laterally extends to a location between an upper section 229 of the front grill 222 and the engine hood 204. Returning to FIG. 2, the headlamp 230 is positioned adjacent to the front grille 222 on a lateral side (e.g., passenger or driver side) of the grille. Thus, the front grille 222 may be positioned on an interior side 233 of the headlamp 230 with regard to a lateral direction. Additionally, the front grille 222 is on a leading side of the vehicle 202 during forward motion of the vehicle.

Continuing with FIG. 2, the airbox 232 is configured to flow filtered intake air to the engine intake conduit 208. The engine intake conduit 208 provides air to at least one cylinder in the engine 206, such as the cylinder 16 shown in FIG. 1. FIG. 2 also shows opposing vehicle side panels 234 of the vehicle's body structure that form a portion of the boundary of the engine compartment 210. As shown in FIG. 2, the first air inlet duct 216 may be positioned adjacent to one of the side panels 234 and/or a frame rail 235.

FIG. 3 shows a front view of the air intake system 200 and vehicle 202, shown in FIG. 2, with the engine hood 204 in a closed position. The air intake system 200, in the depicted example, provides air to the second air inlet duct 220, shown in FIG. 4, via a flow channel 300. As shown in FIG. 3, the flow channel travels through openings 302 in the front grille 222. The openings 302 laterally extend across the front grill 222, in the illustrated example. However, other front grille opening contours have been contemplated. Positioning the flow channel 300 in this location enables ambient air with a low temperature to be provided to the airbox 232, shown in FIG. 2. Furthermore, the front grille 222 protects the second air inlet duct 220 from external debris.

FIG. 3 also shows a first flow channel 304 and a second flow channel 306, in the air intake system 200, that provide air to the first air inlet duct 216, shown in FIG. 2. The first flow channel 304 travels through the gap 308 between the engine hood 204 and the headlamp 230 and into a second compartment 228 below the engine hood 204 and above the beauty cover 214, shown in FIG. 2. The second flow channel 306 travels through openings 307 in the front grille 222. Subsequently, the second flow channel 306 travels through an air conduit 224 extending between the first compartment 226 behind the front grille 222, shown in FIG. 4, and the second compartment 228, shown in FIG. 2. In this way, the first air inlet duct 216 can receive airflow from multiple shielded locations that may be less susceptible to drawing in road debris (e.g., snow, ice, rocks, etc.). However, in other examples, additional or alternative flow channels providing air to the air inlet ducts, have been contemplated.

FIG. 3 also shows the front grille 222 extending into a recessed section 310 of the headlamp 230. Arranging the front grille 222 in this manner enables the second air inlet duct 220 to be positioned behind the grille.

In one example, the first air inlet duct 216, the first flow channel 304, the second flow channel 306, shown in FIG. 3, and/or the airbox 232, shown in FIG. 2 may form a first air inlet flow path routing airflow to the engine intake conduit 208, shown in FIG. 2. Continuing with such an example, the second air inlet duct 220, shown in FIG. 4, the flow channel 300 including openings 302, and/or the airbox 232, shown in FIG. 2, may form a second air inlet flow path routing air through a porous materials such as the foam plug 402, shown in FIG. 4, to the engine intake conduit 208, shown in FIG. 2. The foam plug 402 may be configured to adapt to changes in ambient temperature. It will be appreciated that the foam plug 402 may be similar to the foam plug 30, shown in FIG. 1. Thus, the foam plug 402, shown in FIG. 4, may be configured to inhibit airflow through the second air inlet duct 220 when the foam is below a threshold temperature and allow airflow therethrough when the foam is above the threshold temperature. In this way, the airbox has two separate flow paths that enable increased airflow to be provided to the airbox during lower risk conditions, thereby increasing combustion efficiency. However, during higher risk conditions, the second flow path may be essentially blocked by snow particulates in the foam to reduce the likelihood of snow, ice, and/or other external debris being sucked into intake system and negatively impacting combustion operation.

Turning again to FIG. 4, which shows a front view of the vehicle 202 without the front grille 222 and the engine hood 204, shown in FIGS. 2 and 3, to reveal the location of the first air inlet duct 216 and the second air inlet duct 220.

As shown in FIG. 4, the first air inlet duct 216 is positioned vertically above the second air inlet duct 220. Positioning the air inlet ducts in this manner enable the first air inlet duct 216 to be more protected from the external environment than the second air inlet duct 220. Additionally, when the second air inlet duct 220 is positioned below the first air inlet duct 216 the second air inlet duct may have a greater airflow rate and/or receive cooler air than the first air inlet duct. Furthermore, the second air inlet duct 220 is positioned external to the engine compartment 210, in the illustrated example. Additionally, at least an inlet opening of the first air inlet duct 216 may be positioned external to the engine compartment 210. Consequently, the temperature of the air drawn into the inlet ducts may be reduced when compared to ducts located in the engine compartment. As previously discussed, the engine compartment seal 212 may form a portion of the boundary between the engine compartment 210 and external components. The second air inlet duct 220 is also shown positioned adjacent to a grille reinforcement structure 404. In this way, both the air inlet ducts can be spaced away from hot engine components, thereby decreasing the temperature of the air traveling into the ducts. However, other locations of both the first and second air inlet ducts have been contemplated. For instance, the first and/or second air inlet duct may be positioned in the driver or passenger side fender, tucked into a wheel well, under-hood adjacent to a cowl, etc.

FIG. 4 also shows the air conduit 224 providing airflow between the first compartment 226 and the second compartment 228. In this way, air can be routed in a protected manner to the first air inlet duct 216 away from hot engine components. As a result, the temperature of the air provided to the first air inlet duct 216 may be reduced while providing a shielded flow path to the duct. The air conduit 224 extends in a vertical direction, in the illustrated example. However, alternate routing of the air conduit 224 has been contemplated.

FIG. 4 also shows the first air inlet duct 216 extending upward from the beauty cover 214 to a location between sections of the engine compartment seal 212. In this way, the duct may act to draw in increased amounts of air while being protected by the engine hood 204, shown in FIG. 3. Additionally, the beauty cover 214 may be recessed to accommodate the first air inlet duct 216, in one example.

FIG. 5 shows another view of the air intake system 200. The first air inlet duct 216, the second compartment 228, the engine compartment seal 212, the airbox 232, and the engine intake conduit 208, are shown in FIG. 5. A portion of the housing of the airbox 232 is removed in FIG. 5 to show a filter 500 included in the airbox. FIG. 5 also shows clips 501 configured to releasably attach a removable section of the airbox 232. The filter 500 is configured to trap particulates from the air provided by both the first air inlet duct 216 and the second air inlet duct 220, shown in FIG. 4. In this way, clean air can be provided to the engine intake conduit 208.

FIG. 5 shows the first air inlet duct 216 including a housing lip 502. As shown, the housing lip 502 is aligned with the engine compartment seal 212 to enable the housing lip to seal with a portion of the engine hood 204, shown in FIGS. 2 and 3. Therefore, in the depicted example, the housing lip 502 and the engine compartment seal 212 may interface with the engine hood 204, shown in FIGS. 2 and 3, to seal the engine compartment 210. Additionally, it will be appreciated that the lip 502 may be positioned between two sections of the engine compartment seal 212. However, in other examples, the engine compartment seal 212 may extend across the lip 502. Consequently, the second air inlet duct 220 may be efficiently packaged in the air intake system 200 to reduce the profile of the system. As a result, space saving gains can be achieved by the air intake system 200.

FIG. 6 shows a detailed view of the first air inlet duct 216, the second air inlet duct 220, the airbox 232, and the engine intake conduit 208. In FIG. 6, the foam plug 402 extends across an opening 600 of the second air inlet duct 220. On the other hand, the first air inlet duct 216 includes an opening 602 that is not obstructed by a plug. It will be appreciated that the opening 602 is positioned external to the engine compartment 210, shown in FIG. 2. As discussed above, the foam plug 402 is designed to inhibit airflow through the opening 600 of the second air inlet duct 220 when the foam is below a threshold temperature (e.g., 0 degrees Celsius, 2 degrees Celsius, between −5 and 5 degrees Celsius, etc.) and when the opening has drawn in snow and/or ice particles. Conversely, when the foam is above the threshold temperature the foam plug 402 allows airflow through the opening 600 of the second air inlet duct 220. To enable the temperature adaptive functionality of the foam plug 402 the plug may be constructed out of a polyether and/or have a porosity between 30 and 80 pores per inch or between 40 and 60 pores per inch. However, other foam porosities and foam plug materials have been contemplated. Specifically, in one example, the pores in the foam may clog with snow and/or ice particulates when the foam is below the threshold temperature. Conversely, when the foam is above the threshold temperature the pores in the foam may thaw and return to a porous state where air can pass therethrough. Specifically, in one example, when the foam is above the threshold temperature (e.g., 2 degrees Celsius, 0 degrees Celsius, etc.,) the foam may be soft and enable air to easily pass through. On the other hand, when the foam is below the threshold temperature the foam may still be soft but when snow particles enter the inlet the snow particles attach to the polyether and block pores in the foam. In such an example, the structure of the foam may not change when the foam warms after it is below the threshold temperature. However, in other examples, the structure of the foam may change based on the temperature of the foam. In this way, the foam plug may selectively impede airflow therethrough, based on the temperature of the foam in the foam plug.

Further, in one example, a cross-sectional area of the opening 602 of the first air inlet duct 216 may be greater than a cross-sectional area of the opening 600 of the second air inlet duct 220. In this way, the first air inlet duct 216 may provide a greater amount of airflow to downstream components than the second air inlet duct 220 to enable the engine to achieve a desired vacuum pressure. The cross-sectional areas of the openings may be measured on a plane perpendicular to the direction of airflow into the ducts, in one example. Additionally, the first air inlet duct 216 includes a section 604 extending in a downward direction toward the airbox 232. The second air inlet duct 220 is show including a section 606 extending in a rearward direction toward the airbox 232. Section 606 may also curve away from a side of the vehicle toward the front grille 222, shown in FIGS. 2 and 3, to enable the duct to be routed around sections of the headlamp 230, shown in FIGS. 2 and 3. Routing the air inlet ducts in this manner may enable space saving gains to be achieved in the air intake system 200. However, other air inlet duct profiles may be used, in other examples. Additionally, the first air inlet duct 216 opens into a section of the housing 608 above the location where the second air inlet duct 220 opens into the housing. In this way, the airflow streams from the inlet ducts may merge in the housing 608 to provide a compact flow arrangement. Further, it will be appreciated that, in the housing 608, the confluence of airflow from the ducts is upstream of the filter 500, shown in FIG. 5.

Additionally, FIG. 6 shows the first air inlet duct 216 positioned longitudinally rearward of the second air inlet duct 220 with regard to a direction 610 of forward travel of the vehicle. When the ducts are positioned in this manner the first air inlet duct 216 may be positioned in a more protected location than the second air inlet duct 220. The direction of forward travel is parallel to the Y axis and is an axis indicating the direction of vehicle motion, when the vehicle 202, shown in FIGS. 2 and 3, is traveling in a substantially straight line. Thus, during forward travel the front grille 222, shown in FIG. 2, may be the leading edge of the vehicle 202.

Continuing with FIG. 6, a lateral width 612 of the first air inlet duct 216 is greater than a lateral width 614 of the second inlet duct 220. Conversely, a vertical height 616 of the first air inlet duct 216 is less than a vertical height 618 of the second air inlet duct 220. When the air inlet ducts are shaped in this way, efficiency packaging of the air intake system can be achieved without unduly restricting intake airflow. However, inlets ducts with others relative positioned, widths, heights, profiles, etc., have been contemplated.

FIG. 7 shows a detailed view of the porous material such as the foam plug 402 or sheet of mesh 900 spanning the opening 600 of the second air inlet duct 220. The edges 700 of the foam plug 402 or sheet of mesh 900 are in face sharing contact with a housing 702 of the second air inlet duct 220. In this way, the foam plug 402 or sheet of mesh 900 may cover the opening 600 of the second air inlet duct 220. However, in other examples, the foam plug 402 or sheet of mesh 900 may only extend across a portion of the opening 600. For instance, the foam plug 402 or sheet of mesh 900 may span a lower portion of the opening 600 while leaving an upper portion of the opening unobstructed, in one example. In another example, the foam plug 402 or sheet of mesh 900 may include multiple sections extending vertically and/or horizontally across the opening 600. In such an example, unobstructed slits may be formed between the foam plug or sheet or mesh 900 sections. Furthermore, the foam plug 402 or sheet of mesh 900 may be glued, clipped, and/or otherwise secured in the opening 600 to reduce the chances of the foam plug 402 or sheet of mesh 900 being dislodged from the duct. Thus, in one example, the foam plug 402 or sheet of mesh 900 may be fixedly coupled to the second air inlet duct 220. However, in another example, the foam plug 402 or sheet of mesh 900 may be removably coupled to the second air inlet duct to enable removal, replacement, and/or repair of the foam plug.

Now turning to FIG. 8, map 800 depicts different intake pressure curves in the air intake system, described above, while snow is clogging the second air inlet duct. The example of FIG. 8 is drawn substantially to scale, even though each and every point is not labeled with numerical values. As such, relative differences in distances can be estimated by the drawing dimensions. However, other relative distances may be used, if desired.

Continuing with FIG. 8, map 800 illustrates a vacuum reading downstream of an airbox air filter on the y axis. An increase in the vacuum reading is undesirable because an increased vacuum readings indicates air flow restriction and performance degradation in the system. A distance that a vehicle using the air intake system travels is on the x axis. Curve 802 depicts the vacuum pressure curve of the air intake system using the foam plug, described above, to block the ingested snow. As shown, curve 802 passes a predetermined criteria 808 because foam was present in the second air inlet duct. The predetermined criteria may indicate a threshold when the vehicle begins loosing significant power. Furthermore, the predetermined criteria was statistically validated and determined based on past customer complaints and historical testing. Curves 804 and 806 depict the vacuum pressure curve in an air intake system that does not employ a foam plug. Curves 804 and 806 do not pass the predetermined criteria 808 because snow was allowed to enter the airbox during the test. Thus, intake systems using the foam plug arrangement described herein achieve improved airflow characteristics.

Referring to FIG. 9, it can be appreciated that the porous material 30 can be provided downstream of the section 606 (FIG. 6) of the second air inlet duct 220 as shown. Alternatively, one porous material 30 can be provided toward the end of section 606 of the second air inlet duct 202 as shown in FIG. 6 and a second porous material 30 or a conventional air filter for use in filtering other impurities may be provided as shown in FIG. 9 thereby allowing two different porous materials to be provided in the airflow of the second air inlet duct 220.

FIGS. 1-12 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The invention will further be described in the following paragraphs. In one aspect, an air intake system for an engine is provided. The air intake system comprises a first air inlet duct providing intake air to an engine intake conduit and including an opening positioned external to an engine compartment; and a second air inlet duct positioned upstream of the engine intake conduit and external to the engine compartment, the second air inlet duct including a foam plug selectively impeding airflow through the second air inlet duct, the foam plug spanning an opening of the second air inlet duct.

In another aspect, an air intake system for an engine is provided. The air intake system comprises a first air inlet duct including an opening positioned external to an engine compartment; and a second air inlet duct positioned external to the engine compartment and below the first air inlet, the second air inlet duct having a porous material such as a foam plug spanning an opening of the second air inlet duct, the foam plug including a temperature adaptive foam.

In yet another aspect, an air intake system for an engine is provided. The air intake system comprises a first inlet flow path routing airflow through a gap between an engine hood and a headlamp, a first air inlet duct, and an air filter in an airbox, an opening of the first air inlet duct positioned external to the engine compartment; and a second inlet flow path routing airflow through a front grille below the engine hood, a foam plug spanning a second air inlet duct external to the engine compartment, and the air filter, the foam plug inhibiting airflow through the second air inlet flow path when the foam plug is below a threshold temperature and allowing airflow through the second air inlet flow path when the foam plug is above the threshold temperature.

In any of the aspects herein or combinations of the aspects, the first air inlet duct may be positioned longitudinally behind the second air inlet duct with regard to a direction of forward travel.

In any of the aspects herein or combinations of the aspects, the first air inlet duct may be positioned vertically above the second air inlet duct.

In any of the aspects herein or combinations of the aspects, the first air inlet duct may be positioned below a section of an engine hood.

In any of the aspects herein or combinations of the aspects, the second air inlet duct may be positioned adjacent to a grille reinforcement structure and behind a front grille.

In any of the aspects herein or combinations of the aspects, the first air inlet duct may receive airflow from a first flow channel extending through a gap between an engine hood and a headlamp.

In any of the aspects herein or combinations of the aspects, the first air inlet duct may receive airflow from a second flow channel traveling through an air conduit extending from a first compartment behind a front grille into a second compartment below an engine hood.

In any of the aspects herein or combinations of the aspects, the first air inlet duct may include a housing lip sealing with the engine hood to form a boundary of an engine compartment.

In any of the aspects herein or combinations of the aspects, the foam plug may include a polyether material.

In any of the aspects herein or combinations of the aspects, a porosity of the foam plug may be between 40 and 60 pores per inch.

In any of the aspects herein or combinations of the aspects, a porosity of the foam plug may be between 30 and 80 pores per inch.

In any of the aspects herein or combinations of the aspects, a cross-sectional area of an opening of the first air inlet duct may be greater than a cross-sectional area of an opening of the second air inlet duct.

In any of the aspects herein or combinations of the aspects, selectively impeding airflow through the second air inlet duct may include inhibiting airflow through the second air inlet duct when the foam plug is below a threshold temperature and allowing airflow through the second air inlet duct when the foam plug is above the threshold temperature.

In any of the aspects herein or combinations of the aspects, the first air inlet duct may be positioned longitudinally behind the second air inlet duct with regard to a direction of forward travel.

In any of the aspects herein or combinations of the aspects, the first air inlet duct may be positioned under a section of an engine hood.

In any of the aspects herein or combinations of the aspects, the temperature adaptive foam may include a polyether material and where a porosity of the temperature adaptive foam is between 40 and 60 pores per inch.

In any of the aspects herein or combinations of the aspects, the second air inlet duct may receive airflow from a flow channel travelling through openings in a front grille.

In any of the aspects herein or combinations of the aspects, the second air inlet duct may include a housing lip sealing with the engine hood to form a boundary of the engine compartment.

In any of the aspects herein or combinations of the aspects, the foam plug may include a polyether material and where a porosity of the foam plug may be between 40 and 60 pores per inch.

It will be appreciated that the configurations and features disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An air intake system for an engine, comprising:

a first air inlet duct providing intake air to an engine intake conduit and including an opening positioned external to an engine compartment; and a second air inlet duct positioned upstream of the engine intake conduit and external to the engine compartment, the second air inlet duct including a porous material spanning an opening in the second air inlet duct, the porous material having a plurality of defined openings sized to prevent snow from traveling therethrough and collect on the porous material thereby selectively impeding airflow through the second air inlet duct, where the porous material is a foam plug having a defined porosity, where the porosity of the foam plug is between 30 and 80 pores per inch, and where selectively impeding airflow through the second air inlet duct includes inhibiting airflow through the second air inlet duct when the foam plug is below a threshold temperature and allowing airflow through the second air inlet duct when the foam plug is above the threshold temperature.

2. The air intake system of claim 1, where the first air inlet duct is positioned longitudinally behind the second air inlet duct with regard to a direction of forward travel of a vehicle in which the engine is mounted.

3. The air intake system of claim 1, where the first air inlet duct is positioned vertically above the second air inlet duct with respect to gravity with the engine mounted in a vehicle.

4. The air intake system of claim 1, where the second air inlet duct is positioned adjacent to a grille reinforcement structure and behind a front grille of a vehicle in which the engine is mounted.

5. The air intake system of claim 1, where a cross-sectional area of an opening of the first air inlet duct is greater than a cross-sectional area of an opening of the second air inlet duct.

6. The air intake system of claim 1, further including a second porous material operably received within the second air inlet duct.

7. An air intake system for an engine of a vehicle, comprising:

a first air inlet duct including an opening positioned external to an engine compartment; and a second air inlet duct positioned external to the engine compartment and below the first air inlet duct, the second air inlet duct having a porous material spanning an opening in the second air inlet duct, the porous material having a plurality of defined openings sized to prevent snow from traveling therethrough and collect on the porous material thereby selectively impeding airflow through the second air inlet duct, where selectively impeding airflow through the second air inlet duct includes inhibiting airflow through the second air inlet duct when the porous material is below a threshold temperature and allowing airflow through the second air inlet duct when the porous material is above the threshold temperature.

8. An air intake system for an engine, comprising:

a first inlet flow path routing airflow through a gap between an engine hood and a headlamp, a first air inlet duct, and an air filter in an airbox, an opening of the first air inlet duct positioned external to the engine compartment; and a second inlet flow path routing airflow through a front grille below the engine hood, a porous material spanning a second air inlet duct external to the engine compartment, and the air filter, the porous material having a plurality of defined openings sized to prevent snow from traveling therethrough and collect on the porous material thereby selectively impeding airflow through the second air inlet duct, where selectively impeding airflow through the second air inlet duct includes inhibiting airflow through the second air inlet duct when the porous material is below a threshold temperature and allowing airflow through the second air inlet duct when the porous material is above the threshold temperature.

9. The air intake system of claim 8, where the first air inlet duct includes a housing lip sealing with the engine hood to form a boundary of the engine compartment.

10. The air intake system of claim 8, where the porous material is a sheet of mesh formed with a material selected from the group consisting of polypropylene, nylon, metal, and alloy.

11. The air intake system of claim 8, wherein the porous material is a sheet of mesh.

12. The air intake system of claim 11, wherein the sheet of mesh is substantially planar and has a plurality of spaced apart holes therethrough, each hole of the spaced apart holes having a defined opening size therethrough.

13. The air intake system of claim 12, wherein the plurality of spaced apart holes are square-shaped and the defined opening size of each hole of the plurality of spaced apart holes is between 1 millimeter by 1 millimeter to 5 millimeters by 5 millimeters, inclusive.

14. The air intake system of claim 12, wherein the plurality of spaced apart holes are separated by a support structure having a defined width.

15. The air intake system of claim 14, wherein the defined width is between 0.5 millimeters to 4 millimeters.

16. The air intake system of claim 15, where the porous material is a sheet of planar mesh having a plurality of spaced-apart openings therethrough, each opening in the plurality of openings having a defined opening size between 1 millimeter to 4 millimeters across, inclusive.

17. The air intake system of claim 12 wherein each hole of said plurality of holes is shaped from the group consisting of square, circular, rectangular, triangular, diamond, and trapazoid.

* * * * *